US007491010B2

(12) United States Patent
Cuny et al.

(10) Patent No.: US 7,491,010 B2
(45) Date of Patent: Feb. 17, 2009

(54) ROAD MANHOLE

(75) Inventors: Arnaud Cuny, Domgermain (FR); Jacky Boca, Dieulouard (FR)

(73) Assignee: Saint-Gobain Pam, Nancy (FR)

( * ) Notice: Subject to any disclaimer, the term of this patent is extended or adjusted under 35 U.S.C. 154(b) by 0 days.

(21) Appl. No.: 11/954,412

(22) Filed: Dec. 12, 2007

(65) Prior Publication Data

US 2008/0145147 A1 Jun. 19, 2008

(30) Foreign Application Priority Data

Dec. 14, 2006 (FR) ..... 06 10908

(51) Int. Cl.
*E02D 29/16* (2006.01)
*E02D 29/14* (2006.01)

(52) U.S. Cl. ..... 404/25; 52/19; 52/20

(58) Field of Classification Search ..... 11/25, 11/26; 52/19, 20

See application file for complete search history.

(56) References Cited

U.S. PATENT DOCUMENTS

| | | | | |
|---|---|---|---|---|
| 3,308,727 A | | 3/1967 | Hurt, Jr. | |
| 3,920,347 A | * | 11/1975 | Sauriol et al. | 404/25 |
| 4,101,236 A | * | 7/1978 | Meyer | 404/25 |
| 4,187,647 A | * | 2/1980 | Hall | 52/20 |
| 4,203,190 A | * | 5/1980 | Temple et al. | 29/451 |
| 4,440,407 A | | 4/1984 | Gagas | |
| 4,608,787 A | | 9/1986 | Carlson | |
| 4,706,718 A | * | 11/1987 | Milo | 141/86 |
| 4,834,574 A | | 5/1989 | Bowman | |
| 5,021,261 A | * | 6/1991 | Bowman | 427/286 |
| 5,100,257 A | * | 3/1992 | Centa | 404/25 |
| 6,435,764 B1 | * | 8/2002 | McNeely | 404/26 |

FOREIGN PATENT DOCUMENTS

| | | |
|---|---|---|
| EP | 1 452 648 A1 | 9/2004 |
| FR | 2 153 823 | 5/1973 |
| FR | 2 780 997 A1 | 1/2000 |

* cited by examiner

*Primary Examiner*—Raymond W Addie
(74) *Attorney, Agent, or Firm*—Sughrue Mion, PLLC

(57) ABSTRACT

This road manhole comprises a frame (4) which delimits an opening (6) and which is provided with an internal collar (8) which extends radially inwards, a cover (10) which comprises a blocking web (12) and a cylindrical skirt (14) which complements the internal collar (8), the blocking web and the skirt defining a concave corner (16), and a main gasket (18) which is arranged on the internal collar (8) and which is interposed in the closed state between the cover (10) and the frame (4).

The road manhole (2) comprises an auxiliary gasket (20) which is in contact, at least in the closed state, with the concave corner (16).

17 Claims, 1 Drawing Sheet

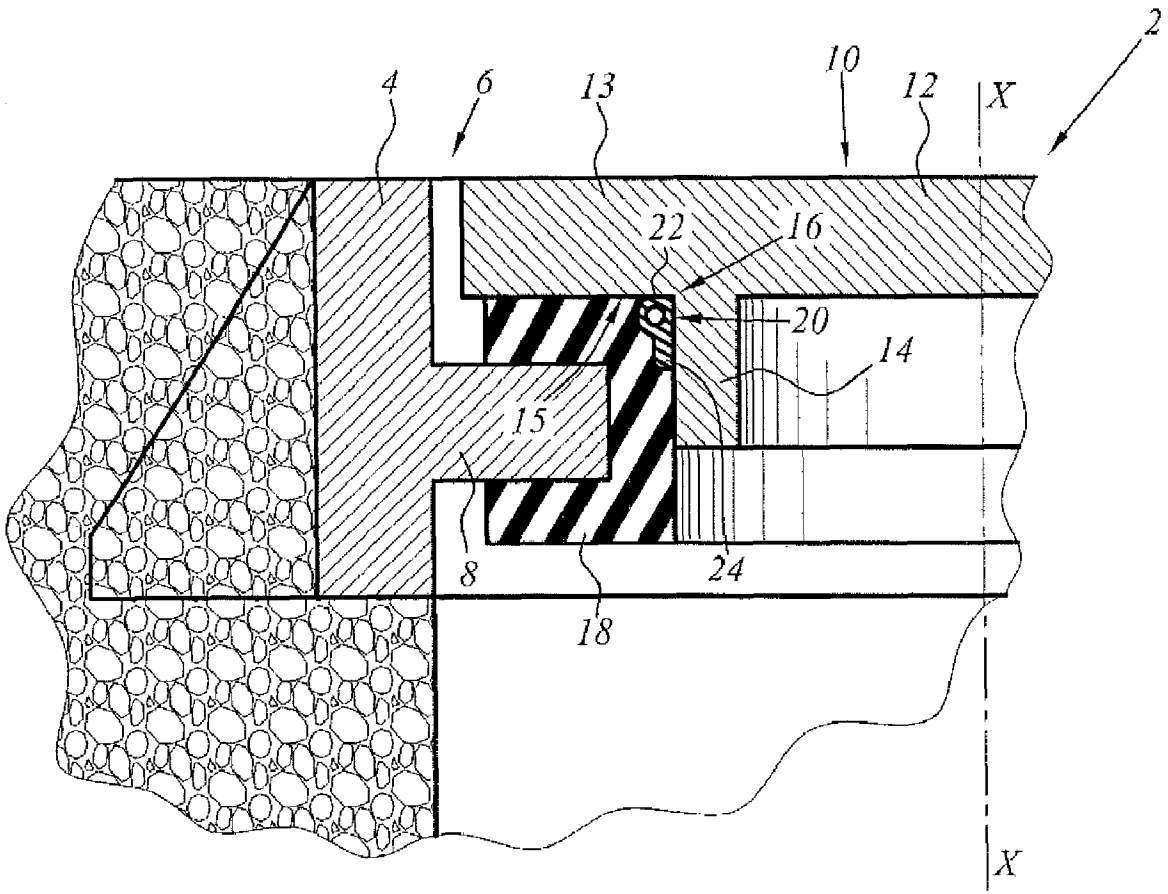
2
X
X
12
10
14
16
20
22
24
13
18
15
6
8
4

ROAD MANHOLE

BACKGROUND OF THE INVENTION

The present invention relates to a road manhole of the type defining a centre axis and comprising:

- a frame which delimits an opening and which is provided with an internal collar which extends radially inwards,
- a cover which comprises a blocking web which is intended to block the opening and a cylindrical skirt which is centred on the centre axis and which substantially complements the internal collar, the blocking web and the skirt defining a concave corner which is directed radially outwards relative to the centre axis, and
- a main gasket which is arranged on the internal collar and which is interposed between the cover and the frame when the cover is in a closed position, the road manhole comprising an auxiliary gasket which is, at least in the closed state of the manhole, arranged on the skirt and which is in contact with the concave corner.

Road manholes of this type are known from the prior art. The main gasket is used in order to acoustically insulate the manhole in the closed state and to reduce the quantity of water which can enter the gap between the frame and the cover, but without ensuring complete fluid-tightness.

The object of the invention is to improve the fluid-tightness of this road manhole, using simple and economic means.

SUMMARY OF THE INVENTION

To this end, the invention relates to a manhole of the type indicated, characterised in that the main gasket and the auxiliary gasket are formed by two separate components.

According to specific embodiments, the road manhole according to the invention comprises one or more of the following features:

- the auxiliary gasket comprises a first portion which forms a sealing lip;
- the first portion is in the form of a torus;
- the first portion has a hollow cross-section, in particular in the form of a ring;
- the auxiliary gasket comprises a second portion which is fixedly joined to the first portion and which has a non-circular cross-section;
- the second portion extends the first portion axially inwards and presses, over the entire axial length thereof, on the skirt;
- the second portion of the auxiliary gasket is suitable for preventing sliding and torsion of the auxiliary gasket on the skirt;
- the main gasket and the auxiliary gasket are produced from resilient material, preferably from the same resilient material; and
- the auxiliary gasket is suitable for being placed against the main gasket and the sealing lip when the cover is closed on the frame.

The invention will be better understood from a reading of the following description, given purely by way of example and with reference to the single drawing, which illustrates a portion of a road manhole according to the invention.

BRIEF DESCRIPTION OF THE DRAWING

The single FIGURE is a section through a road manhole according to the invention, generally designated 2.

DETAILED DESCRIPTION OF THE DISCLOSURE

The road manhole 2 comprises a frame 4 and a cover 10 which is supported by the frame. The frame 4 and the cover 10 define a centre axis X-X and are preferably produced from ductile cast iron.

The frame 4 delimits an opening 6 and comprises an internal collar 8 which serves to support the cover 10.

The cover 10 has a substantially planar blocking web 12 which is perpendicular relative to the centre axis X-X and which blocks the opening 6 when the cover 10 is in a closing position on the frame and a cylindrical skirt 14 which is located below the blocking web 12 and which extends inwards parallel with the centre axis X-X.

The cylindrical skirt 14 is centred on the centre axis X-X and extends in the opening delimited by the internal collar 8. The skirt 14 is remote from the periphery of the blocking web 12, the blocking web thus delimiting a peripheral edge 13 which has an inner surface 15 which is perpendicular relative to the centre axis X-X and which is connected to the skirt 14. The inner surface 15 and the skirt 14 thus define a concave corner 16 which is directed radially outwards relative to the centre axis X-X.

The road manhole 2 is further provided with a main gasket 18 which is produced from resilient material, such as elastomer material, for example. The main gasket 18 is arranged on the internal collar 8 and is located between the cover 10 and the frame 4 in the closed state of the manhole 2. More precisely, the main gasket 18 has a C-shaped radial cross-section which surrounds the internal collar 8. In a closed position, the inner surface 15 of the edge 13 of the manhole rests on the main gasket 18, thereby preventing rattling noises of the cover on the frame when vehicles pass. In addition to this acoustically insulating function, the main gasket 18 also provides primary fluid-tightness with respect to surface water which is capable of entering the gap between the cover and the frame.

The road manhole 2 also comprises an auxiliary gasket 20 which is intended to improve the fluid-tightness with respect to surface water. This auxiliary gasket 20 is arranged on the skirt 14 and is in contact with the concave corner 16. The auxiliary gasket 20 is produced in one piece and from a resilient material, for example, from elastomer material. Preferably, the two gaskets 18 and 20 are produced from the same material. The auxiliary gasket 20 comprises a first portion which forms a sealing lip 22 and a second portion 24 which is fixedly joined to the first portion 22.

The first portion 22 is generally in the form of a torus and has a hollow radial cross-section which is of annular shape and which facilitates the deformation thereof.

The second portion 24 extends the first portion 22 axially inwards and has a non-circular radial cross-section, in this instance a substantially rectangular cross-section. In this manner, the radial cross-section of the auxiliary gasket 20 is substantially P-shaped.

It should be noted that the second portion 24, over the entire axial length thereof, presses on the skirt 14 and substantially serves to prevent the sliding and the torsion of the auxiliary gasket 20 on the skirt 14. Furthermore, the axial length of the second portion 24 is greater than the axial length of the first portion 22.

When the cover 10 is closed on the frame 4, the auxiliary gasket 20 is positioned against the main gasket 18 and at least the sealing lip 22 is resiliently compressed. In this manner, this auxiliary gasket 20 substantially increases the fluid-tightness of the road manhole 2.

The auxiliary gasket 20 according to the invention can be readily installed on existing road manholes.

The invention claimed is:

1. Road manhole, of the type defining a centre axis (X-X) and comprising:

a frame (4) which delimits an opening (6) and which is provided with an internal collar (8) which extends radially inwards, a cover (10) which comprises a blocking web (12) which is intended to block the opening (6) and a cylindrical skirt (14) which is centred on the centre axis (X-X) and which substantially complements the internal collar (8), the blocking web (12) and the skirt defining a concave corner (16) which is directed radially outwards relative to the centre axis (X-X), and a main gasket (18) which is arranged on the internal collar (8) and which is interposed between the cover (10) and the frame (4) when the cover is in a closed position, the road manhole (2) comprising an auxiliary gasket (20) which is, at least in the closed state of the manhole, arranged on the skirt (14) and which is in contact with the concave corner (16), characterised in that the main gasket (18) and the auxiliary gasket (20) are formed by two separate components.

2. Manhole according to claim 1, characterised in that the main gasket (18) and the auxiliary gasket (20) are produced from resilient material, preferably from the same resilient material.

3. Manhole according to claim 1, wherein said main gasket (18) and said auxiliary gasket (20) are independent from each other.

4. Manhole according to claim 1, characterised in that the auxiliary gasket (20) is placed against the main gasket (18) during closure of the cover (10) on the frame.

5. Manhole according to claim 1, characterised in that the auxiliary gasket (20) comprises a first portion (22) which forms a sealing lip.

6. Manhole according to claim 5, characterised in that the first portion (22) is in the form of a torus.

7. Manhole according to claim 5, characterised in that the first portion has a hollow cross-section, in particular in the form of a ring.

8. Manhole according to claim 5, characterised in that the auxiliary gasket comprises a second portion (24) which is fixedly joined to the first portion (22) and which has a non-circular cross-section.

9. Manhole according to claim 8, characterised in that the second portion (24) extends the first portion (22) axially inwards and, over the entire axial length thereof, presses on the skirt (14).

10. Manhole according to claim 8, characterised in that the second portion (24) of the auxiliary gasket is suitable for preventing sliding and torsion of the auxiliary gasket on the skirt.

11. Manhole according to claim 5, characterised in that the auxiliary gasket (20) is against the main gasket (18) during closure of the cover (10) on the frame.

12. Manhole according to claim 11, characterised in that the first portion (22) is in the form of a torus.

13. Manhole according to claim 11, characterised in that the first portion has a hollow cross-section, in particular in the form of a ring.

14. Manhole according to claim 11, characterised in that the auxiliary gasket comprises a second portion (24) which is fixedly joined to the first portion (22) and which has a non-circular cross-section.

15. Manhole according to claim 14, characterised in that the second portion (24) extends the first portion (22) axially inwards and, over the entire axial length thereof, presses on the skirt (14).

16. Manhole according to claim 14, characterised in that the second portion (24) of the auxiliary gasket is suitable for preventing sliding and torsion of the auxiliary gasket on the skirt.

17. Manhole according to claim 11, characterised in that the main gasket (18) and the auxiliary gasket (20) are produced from resilient material, preferably from the same resilient material.

* * * * *